United States Patent [19]

Lang

[11] Patent Number: 4,564,723

[45] Date of Patent: Jan. 14, 1986

[54] SHIELDED RIBBON CABLE AND METHOD

[75] Inventor: Donald D. Lang, Garden Grove, Calif.

[73] Assignee: Allied Corporation, Morris Township, Morris County, N.J.

[21] Appl. No.: 553,651

[22] Filed: Nov. 21, 1983

[51] Int. Cl.[4] ..... H01B 13/06; H01B 7/08; H01B 7/34

[52] U.S. Cl. ..... 174/36; 156/56; 174/115; 174/117 F

[58] Field of Search ..... 174/36, 104, 115, 117 F; 264/174, 156, 139, 146; 156/56

[56] References Cited

U.S. PATENT DOCUMENTS

| | | | |
|---|---|---|---|
| 2,446,387 | 8/1948 | Peterson | 174/102 C |
| 2,771,386 | 11/1956 | Merz et al. | 264/174 |
| 3,576,723 | 4/1971 | Angele et al. | 174/36 |
| 3,612,744 | 10/1971 | Thomas | 174/36 |
| 3,663,739 | 5/1972 | Chevrier | 174/117 F X |
| 3,834,960 | 9/1974 | Prentice et al. | 174/102 C X |
| 4,155,613 | 5/1979 | Brandeau | 174/117 F X |
| 4,287,385 | 9/1981 | Dombrowsky | 174/117 F X |
| 4,288,916 | 9/1981 | Verma . | |
| 4,341,509 | 7/1982 | Harlow | 264/174 X |
| 4,371,745 | 2/1983 | Sakashita | 174/36 X |

FOREIGN PATENT DOCUMENTS

| | | | |
|---|---|---|---|
| 17077 | 10/1980 | European Pat. Off. | 174/36 |
| 59005 | 9/1982 | European Pat. Off. | 174/36 |
| 2547152 | of 0000 | Fed. Rep. of Germany . | |
| 3315962 | of 0000 | Fed. Rep. of Germany . | |
| 2754342 | 6/1979 | Fed. Rep. of Germany | 174/36 |
| 2519797 | of 0000 | France . | |
| 134160 | 2/1979 | German Democratic Rep. | 174/117 F |
| 2047947 | 12/1980 | United Kingdom | 174/117 F |
| 2070320 | 9/1981 | United Kingdom | 174/36 |

*Primary Examiner*—A. T. Grimley
*Assistant Examiner*—Morris H. Nimmo
*Attorney, Agent, or Firm*—Roger H. Criss

[57] ABSTRACT

A shielded ribbon cable is formed either by trimming a conventional ribbon cable to expose one or both edge conductors, and coating the cable by painting it with a conductive paint or covering it with an extruded conductive plastic layer, or by forming a ribbon cable of individually-coated wires, one or both edge conductors having a conductive coating, and subsequently painting it with a conductive paint or covering it with an extruded conductive plastic layer. One or both edge conductors thus serve as drain wires for the shield formed by the external covering of conductive paint or conductive extruded plastic.

9 Claims, 10 Drawing Figures

SHIELDED RIBBON CABLE AND METHOD

The instant application relates to the field of electrical conductors. In particular, the instant application relates to the field of shielded electrical conductors.

BACKGROUND OF THE INVENTION

In the transmission of electrical signals along a conductor, it is often desirable to isolate the conductor from external sources of electromagnetic fields, to prevent interference with the signals carried by the conductor, or to prevent electromagnetic radiation from the conductor from interfering with signals carried by other conductors. Conventionally, a braided metallic shield is placed over the conductor, and spaced from it by a dielectric layer. Establishing connection to such shield braiding is, as is well-known, a somewhat difficult task, involving manual operations for preparation of the cable end. Making electrical connection to the shielding braid for establishing a grounded shield may be facilitated by the installation of a drain wire between the shield braid and the dielectric layer. Such a drain wire is usually provided where, to obtain a greater percentage of shielding efficiency, a metalized plastic film is used as the shielding member, since such film is not capable of being terminated by conventional techniques such as soldering. This technology has been applied to ribbon cables composed of miniature coaxial cables, with the drain wires disposed generally in the same planes as the central conductors of the coaxial cables, to facilitate simultaneous termination of the central conductors and individual drain wires.

However, when a shield covering an entire ribbon cable is desired, it has been necessary to place a shield braid, or a wrapping of metalized plastic film around the ribbon cable, provide a drain wire placed between the shield and the ribbon cable, and place a jacket portion over the shield braid to retain it in place. As will be apparent, this technique does not lend itself to automatic or mass termination of the conductors of the ribbon cable and the shield braid, but rather requires manual operations for termination of the shield braid.

The instant invention overcomes this and other deficiencies of the prior art.

SUMMARY OF THE INVENTION

The instant invention provides an easy to manufacture, mass terminatable shielded ribbon cable, by forming or modifying a ribbon cable with at least one of its outermost edge conductors electrically exposed, and coating the ribbon cable with a conductive material, which makes electrical contact with the outermost edge conductor, the coating serving as a shielding member, and the edge conductor serving as a drain wire. A conventional ribbon cable may be mechanically trimmed to expose the metallic conductor, or, in the case of ribbon cables made from individual, plastic covered wires, the plastic material around the conductor or conductors to be used as outermost edge conductors may be impregnated with conductive material, rendering it conductive, and rendering trimming unnecessary. This is advantageous in that trimming may nick or gouge the outermost conductor, rendering it less able to withstand repeated flexing which may be incurred in a particular application for ribbon cable.

Thus, the instant invention provides both a novel shielded ribbon cable, and a method for manufacturing it.

Thus, it is a primary objective of the invention to provide a method of making shielded ribbon cable by providing a length of ribbon cable having a plurality of laterally-spaced conductors including first and second edge conductors adjacent first and second laterally-spaced edge portions, where at least one of these edge conductors is covered with a layer of a first conductive material, and coating this ribbon cable with a second conductive material in contact with the first conductive material to shield the cable.

It is a primary feature of the invention that the second coating material may be either a conductive paint, or an extruded conductive jacket member, so that the thickness of the resulting shield may be varied as desired, with due consideration for the required flexibility of the ribbon cable.

It is an advantage of the invention that the shield member of such ribbon cable may be terminated simultaneously with the individual signal-carrying conductors.

In accordance with the invention, a shielding layer in accordance with the invention may be applied to a conventional laminated ribbon cable, a laminated ribbon cable with conductive material applied over the outermost edge conductors, an extruded ribbon cable formed by extruding an integral covering over a plurality of bare conductors, an extruded ribbon cable formed by extruding a continuous jacket member around individual plastic covered conductors, an extruded groundplane ribbon cable, or a bonded ribbon cable, in which individual coated conductors are bonded together in a side-by-side arrangement by heat, adhesive, or solvent.

Also, as will be apparent, the instant invention is applicable to twisted-pair ribbon cables by the simple expedient of laying a single edge conductor on or between laminating films as the cable is being formed. This requires only the modification of bonding rollers to accommodate twisted-pair central conductors and single-strand edge conductors, and a wire path for the edge conductor that bypasses the twisting head assembly. The simplicity of such modifications will be apparent to one skilled in the art.

These and other objectives, features and advantages of the invention will become apparent from the detailed description which follows.

DESCRIPTION OF THE PREFERRED EMBODIMENTS

Figure 1:
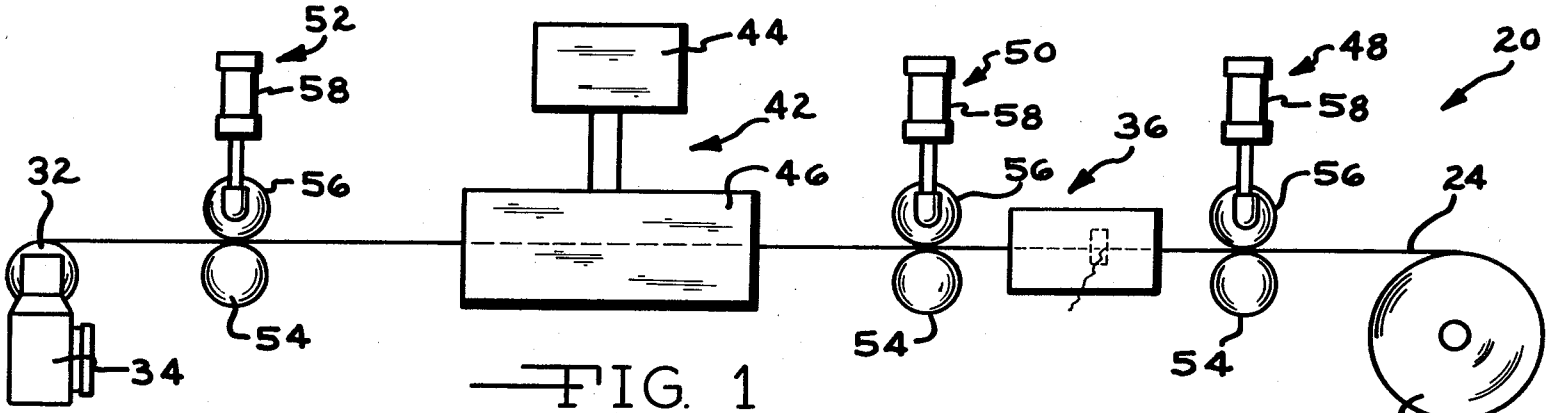
FIG. 1 is a side view, in partially symbolic form, of a suitable apparatus for making ribbon cable according to the invention.
Figure 2:
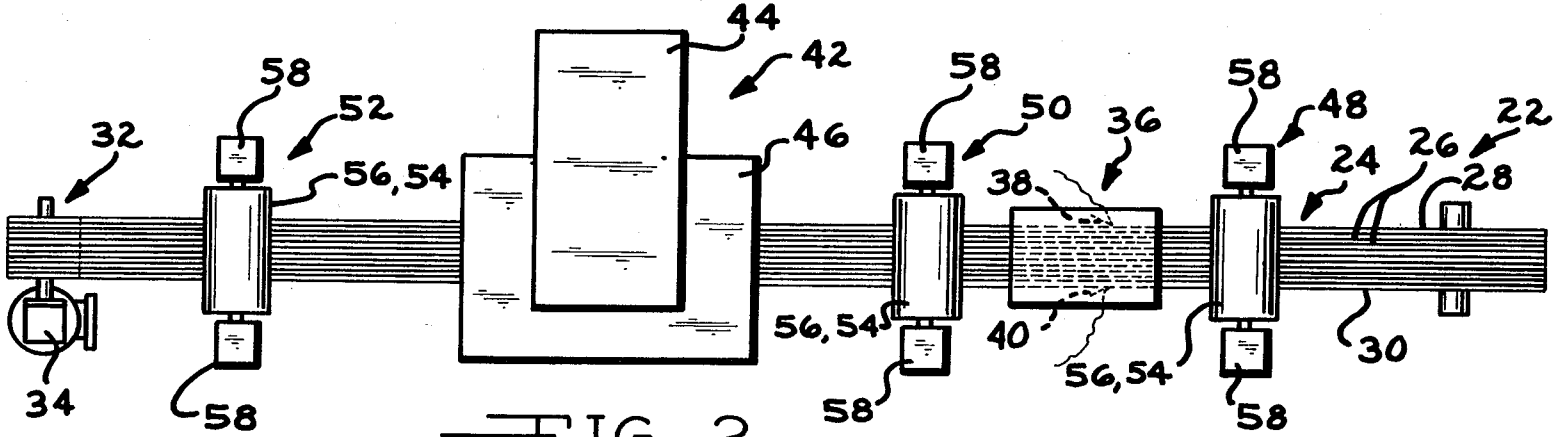
FIG. 2 is a top view of the apparatus shown in FIG. 1.

Referring to FIGS. 1 and 2, there are shown suitable apparatus for implementing the method of the instant invention, and for producing a ribbon cable in accordance with the instant invention. In apparatus 20, a supply reel 22 provides a length of ribbon cable 24 having a plurality of laterally-spaced conductors 26, and first and second edge conductors 28 and 30. Ribbon cable 24 is, after processing according to the invention, taken up on take-up reel 32, which is driven by take-up reel drive 34.

As will be apparent to one skilled in the art, supply reel 22 is not necessary to practice the invention, since the instant invention may be practiced upon ribbon cable as it is being formed, rather than as a separate operation.

From supply reel 22, ribbon cable 24 passes through trimmer station 36, if it is used, which laterally guides ribbon cable 24 and trims the edges of ribbon cable 24 with preferably heated knives 38 and 40. As will become apparent, if trimmer station 36 is used, only one knife 38 or 40 may be used. After trimming, ribbon cable 24 is passed through coating station 42, which includes a supply of coating material 44, and a coating application portion 46. As will become apparent, coating application portion 46 may be in the form of a conductive paint application device, or in the form of an extruder head. The design of either such a device is believed to be well within the skills of one skilled in the relevant art.

Figure 3:
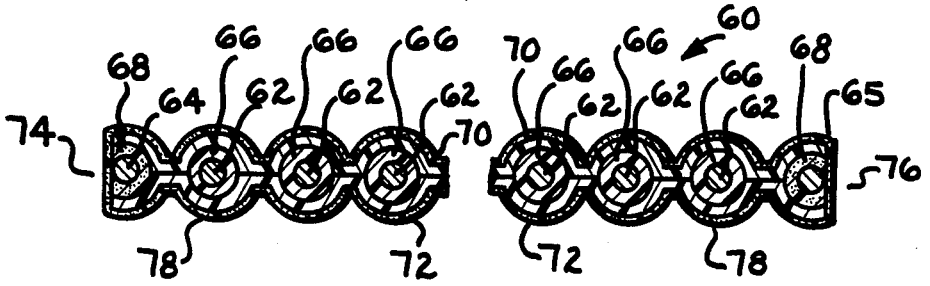
FIG. 3 illustrates the use of a thin shield coating according to the invention with laminated ribbon cable.

Ribbon cable 24 may be kept under appropriate tension by conventional tensioning devices 48, 50 and 52. Tensioning devices 48, 50, 52 may each include a driven roller 54 and a compression roller 56, pressed together by a conventional device here illustrated as a pneumatic cylinder 58. Turning now to the remaining figures, FIG. 3 illustrates a preferred embodiment of the invention, which may be easily applied to laminated ribbon cables, which may include intermittent straight sections as well as twisted-pair sections. For convenience, this embodiment is illustrated at an untwisted section. First embodiment 60 includes a plurality of conductors 62, used to carry signals, and first and second edge conductors 64 and 65. Each signal conductor 62 is surrounded by an insulating coating 66, and edge conductors 64 and 65 are provided with a conductive coating 68. Conductors 62, 64, 65 are maintained precisely laterally spaced between respective upper and lower laminating films 70 and 72, which are laminated to conform with coatings 66, 68 in conventional manner. The resulting ribbon cable is then trimmed at first and second edge portions 74 and 76 to expose conductive coating 68, and a conductive coating 78, in the form of a conductive flexible paint is applied to and surrounds the ribbon cable.

This illustrated embodiment is advantageous in that conventional machinery for producing laminated ribbon cable may be used, and edge portions 74, 76 need only be trimmed to expose conductive coating 68, eliminating the chance of gouging or nicking conductors 64, 65. Also, conductive coating 78 bonds to both conductive coating 68 and conductors 64, 65, which is advantageous in that it is believed a more dependable electrical contact between edge conductor 64, 65 and conductive coating 78 may be obtained.

Figure 4:
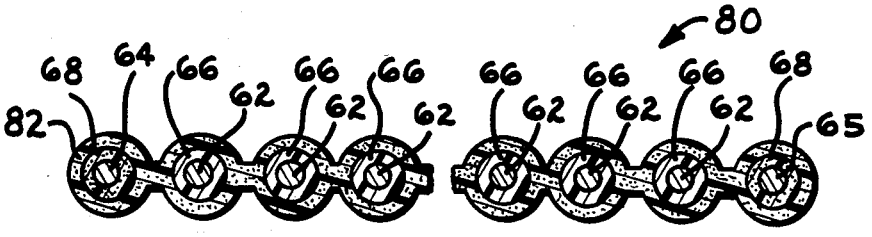
FIG. 4 illustrates the use of a thin shield coating according to the invention, where an extruded jacket member over individually coated conductors serves as a shield member.

FIG. 4 shows a second embodiment 80 of ribbon cable 24, produced by extrusion, using individually coated conductors. As before, signal conductors 62 are provided with insulating coating 66, and first and second edge conductors 64 and 65 are provided with conductive coating 68. Conductors 62, 64, 65 are maintained precisely laterally spaced by an extruded jacket, defining a conductive coating 82 which surrounds each conductor and its respective coating, and forms a shield for second embodiment 80, conductive layer 82 being in electrical contact with conductive layer 68, which is in turn in electrical contact with conductor 64, 65, which serve as drain wires or conductors. Thus, a shield according to the invention may be provided using equipment normally used to form extruded ribbon cable which utilizes conductors which have been previously coated with an insulating or conductive coating.

Figure 5:
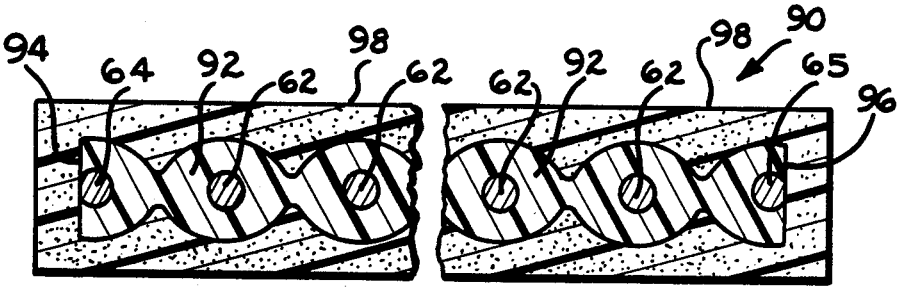
FIG. 5 illustrates a shield member according to the invention as applied to a conventional extruded ribbon cable formed from a plurality of bare conductors.

Turning now to FIG. 5, there is shown a third embodiment of the invention 90, fabricated using conventional ribbon cable formed by extruding a coating over bare wires or conductors. As illustrated, signal conductor 62 and first and second edge conductors 64, 65 are maintained precisely laterally spaced by a unitary extruded jacket defining insulating coating 92. The resulting ribbon cable is then trimmed at first and second edge portions 94, 96 to expose a portion of edge conductors 64, 65. Then, a coating of conductive material is extruded around the ribbon cable to form a shield, in contact with edge conductors 64, 65. The resulting shield according to the invention may be formed in any desired thickness and configuration, for the desired degree of shield effectiveness and flexibility.

Figure 6:
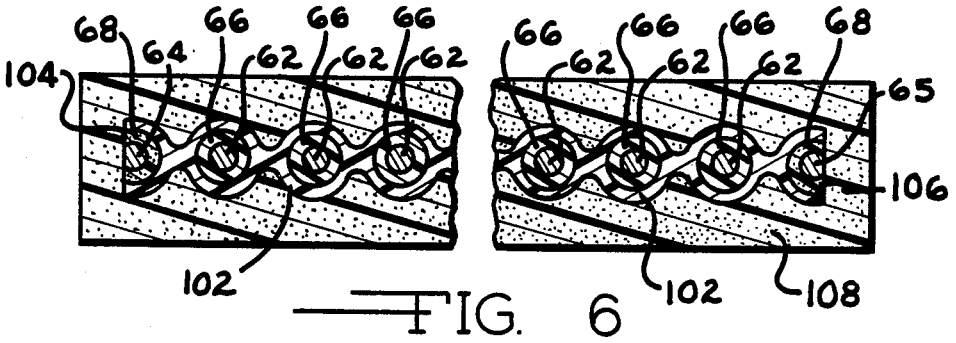
FIG. 6 illustrates a shield member according to the invention as applied to a ribbon cable formed by extruding an insulating jacket over a plurality of coated wires.

Turning now to FIG. 6, there is shown a fourth embodiment of a shielded ribbon cable according to the invention. As in the embodiment shown in FIGS. 3 and 4, each signal conductor 62 is provided with an insulating coating 66, and edge conductors 64, 65 are provided with a conductive coating 68. As will be apparent, edge conductors 64, 65 may also be provided, in this embodiment of the invention, with an insulating coating, without effecting the functionality of the resulting shielded ribbon cable. Conductors 62, 64, 65 are maintained in precisely laterally spaced relationship by an extruded jacket of insulating material 102 conforming to coatings 66, 68. The resulting assembly is then trimmed at first and second edge portions 104, 106 to expose conductive material 68, or, if desired, edge conductors 64, 65. A shield according to the invention is then formed by extruding a layer of conductive material 108 around the ribbon cable, in electrical contact with edge conductors 64, 65, which then serve as drain wires.

Figure 7:
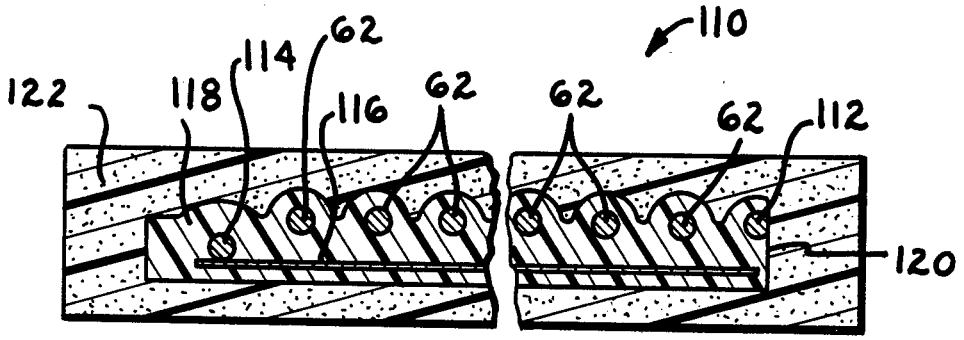
FIG. 7 illustrates a shield member according to the invention with a conventional ground-plane cable, the ground plane being isolated from the shield member.
Figure 8:
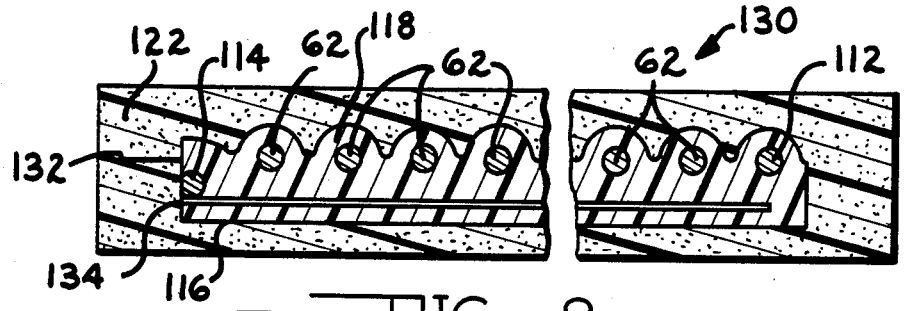
FIG. 8 illustrates a shield member according to the invention with conventional ground-plane cable, with the shield member connected both to the ground plane and to the ground plane drain wire.
Figure 9:
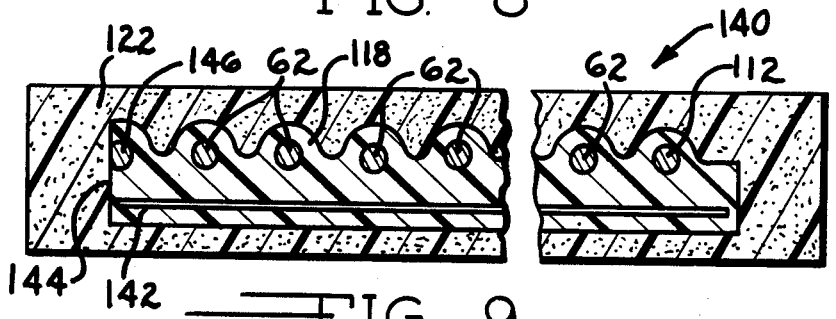
FIG. 9 illustrates a shield member according to the invention, as applied to a ground-plane cable, with the shield member connected only to a single edge conductor.

FIGS. 7–9 illustrate the use of the invention with various configurations and modifications of standard ground-plane ribbon cable. Such cable is composed of a plurality of precisely laterally spaced conductors, with a ground plane underlying the conductors.

As will be apparent from FIG. 7, the basic ribbon cable from which fifth embodiment 110 is formed includes a plurality of signal conductors 62, and edge conductor 112 which normally serves as a signal conductor, and a drain wire 114, which is offset from the plane of signal conductors 62 to be in contact with a ground plane 116 underlying all the conductors of the ribbon cable. The conductor 62, drain wire 114 and ground plane 116 are maintained in predetermined position by extruded plastic jacket 118 of insulating material surrounding conductors 62, 112, ground plane 116 and drain wire 114. The mechanical contact between drain wire 114 and ground plane 116 prevents the intrusion of insulating material 118 therebetween. The resulting cable is then trimmed at edge portion 120, to expose a portion of conductor 112. A covering of conductive material 122 is then extruded around jacket 118 in contact with conductor 112, to form a shielded ribbon cable according to the invention.

FIG. 8 shows a sixth embodiment 130 of a shielded ribbon cable according to the invention. As will be apparent from comparison of FIGS. 7 and 8, in FIG. 8, the conventional ground-plane ribbon cable is trimmed at edge portion 132 to expose both a portion of drain wire 114 and an edge 134 of ground plane 116. Edge 134 would be formed in the process of trimming edge portion 132. Thus, the difference between the embodiments shown in FIGS. 7 and 8 results from a difference in lateral positioning of ribbon cable 24 as it passes through trimmer station 36, shown in FIGS. 1 and 2.

In FIG. 9, a seventh embodiment 140 of a ribbon cable according to the invention is shown. The embodiment illustrated in FIG. 9 differs from that shown in FIGS. 7 and 8 in that the ground-plane ribbon cable is formed without a drain wire, and is provided with a ground plane 142 which is narrower than ground plane 116 so that it will not be exposed in the process of trimming the ground-plane ribbon cable to produce a shielded ribbon cable in accordance with the invention. This ground plane ribbon cable is trimmed at edge portion 144 to expose a portion of an edge conductor 146 before application of covering 122 of conductive material to form a shield, so that the resulting shielded ribbon cable has a drain wire formed by edge conductor 146 in electrical contact with the shield formed by the covering of conductive material 122, leaving ground plane 142 electrically isolated.

Figure 10:
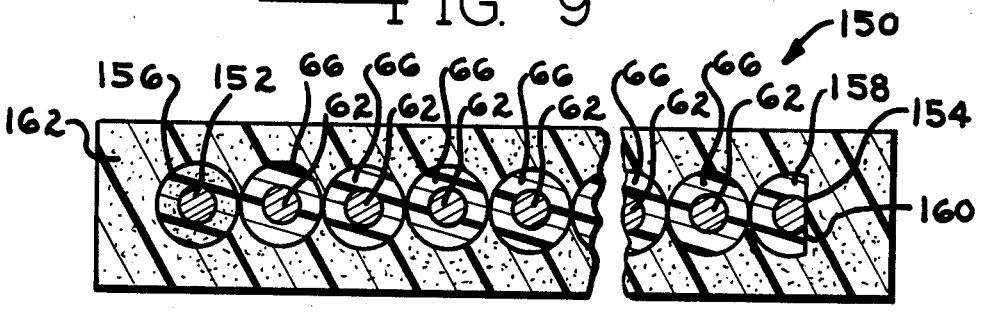
FIG. 10 illustrates a shield member according to the invention, showing how it may be applied to a bonded ribbon cable.

FIG. 10 is illustrative of the application of the invention to conventional bonded ribbon cable, formed by placing conventional coated conductors in an adjacent relationship, and bonding the coating together by the use of solvent, adhesive, or heat, in the case of thermoplastic coatings. Edge conductors may be formed either with a nonconductive, preferably thermoplastic coating, or a conductive, preferably thermoplastic coating. The use of both such coatings is illustrated in FIG. 10, although only one type of coating, preferably conductive, would be used for edge conductors in a commercial embodiment of a shielded bonded ribbon cable.

As illustrated in FIG. 10, an eighth embodiment of a shielded ribbon cable according to the invention by first manufacturing a bonded ribbon cable composed of signal conductors 62 and first and second edge conductors 152 and 154. Each signal conductor 62 is formed with an insulating coating 66, and edge conductors 152, 154 may either be formed with a conductive coating 156, shown as surrounding conductor 152, or an insulating coating 158, shown as associated with edge conductor 154. An insulating coating such as 158 would be trimmed at edge portion 160 to expose a portion of an edge conductor such as 158. No such trimming would be necessary with a conductive coating such as coating 156, surrounding edge conductor 152. Then, a conductive coating 162 of conductive plastic material is extruded around the bonded ribbon cable, in electrical contact with at least one edge conductor which serves as a drain wire, and forms a shielded ribbon cable according to the invention.

As will be apparent to one skilled in the art, numerous modifications and variations of the invention may be made by one skilled in the art, such as by the use of different basic configurations of ribbon cable, and external configurations of the shield member formed by a conductive coating, without departing from the spirit and scope of the invention.

I claim:

1. A method of making shielded ribbon cable, comprising the steps of providing a length of ribbon cable having a plurality of laterally spaced conductors including first and second edge conductors adjacent first and second respective laterally spaced edge portions of said cable, the remaining conductors being surrounded by an insulating layer;

covering at least one of said first and second edge conductors with a layer of a first conductive material;

enclosing said ribbon cable with an insulating material;

trimming at least one of said first and second edge portions of said cable to expose at least a portion of at least one of said first and second edge conductors and said first conductive material at said at least one edge portion of said cable; and coating the trimmed ribbon cable with a second conductive material such that said second conductive material is in electrical contact with both the exposed portion of at least one of said first and second edge conductors, and said first conductive material adjacent said exposed portion to shield said cable.

2. The method of claim 1, including the steps of covering both of said first and second edge conductors with said layer of first conductive material, trimming both of said first and second edge portions of said cable to expose at least a portion of both of said first and second edge conductors and said first conductive material at both of said first and second edge portions of said cable, and coating both the exposed portions of both of said first and second edge conductors and both of said first and second edge portions with said second conductive material.

3. The method of claim 2, wherein the step of coating the trimmed ribbon cable includes the step of passing said cable through an extruder to extrude a conductive plastic material about said cable.

4. The method of claim 2, wherein the step of coating the trimmed ribbon cable includes the step of coating said cable with a conductive paint.

5. A shielded ribbon cable, comprising:

a plurality of longitudinally extending laterally spaced conductors;

said conductors being electrically insulated from each other;

first and second ones of said conductors being disposed adjacent respective first and second edge portions of said ribbon cable;

a first conductive material covering at least one of said first and second ones of said conductors, with a portion of at least one of said first and second ones of said conductors having been trimmed so as to be free of said first conductive material;

a second conductive material surrounding said ribbon cable and being in electrical contact with said at least said one of said first and second ones of said conductors along substantially the entire length thereof and said portion of said at least one of said first and second ones of said conductors which is free of said first conductive material, said second conductive material shielding said ribbon cable, said at least one of said first and second ones of said conductors being a drain conductor for said shielded cable.

6. The shielded ribbon cable of claim 5, wherein said first conductive material extends substantially the entire length of said at least one of said first ones of said conductors.

7. The shielded ribbon cable of claim 6, wherein said first conductive material covers both of said first and second ones of said conductors and said second conductive material is in electrical contact with both of said first and second ones of said conductors at said portion thereof which is free of said first conductive material.

8. The shielded ribbon cable of claim 7, wherein said second conductive material comprises a conductive plastic material.

9. The shielded ribbon cable of claim 7, wherein said second conductive material comprises a conductive paint.

* * * * *